US006402069B1

(12) United States Patent
Østergaard et al.

(10) Patent No.: US 6,402,069 B1
(45) Date of Patent: Jun. 11, 2002

(54) COMMINUTION MACHINE WITH AN EMULSIFIER

(75) Inventors: Anders Østergaard, Høng (DK); Eva Meissner, Biedenkopf; Peter Lauber, Breidenbach, both of (DE)

(73) Assignee: Tiromat Kraemer + Grebe GmbH & Co. KG, Biedenkopf-Wallau (DE)

( * ) Notice: Subject to any disclaimer, the term of this patent is extended or adjusted under 35 U.S.C. 154(b) by 0 days.

(21) Appl. No.: 09/331,558

(22) PCT Filed: Dec. 13, 1997

(86) PCT No.: PCT/EP97/07020

§ 371 (c)(1),
(2), (4) Date: Jun. 21, 1999

(87) PCT Pub. No.: WO98/28077

PCT Pub. Date: Jul. 2, 1998

(30) Foreign Application Priority Data

Dec. 21, 1996 (DE) ..... 296 22 298 U

(51) Int. Cl.[7] ..... B02C 18/36

(52) U.S. Cl. ..... 241/82.4; 241/57; 241/82.5; 241/152.2; 241/261.1

(58) Field of Search ..... 241/57, 82.4, 82.5, 241/152.2, 261.1

(56) References Cited

U.S. PATENT DOCUMENTS 930,920 A * 8/1909 Bartz
2,963,232 A * 12/1960 Smith ..... 241/259
3,305,183 A * 2/1967 Morden ..... 241/260
3,788,567 A * 1/1974 Yamada ..... 241/247
3,861,655 A * 1/1975 Wright ..... 259/107
3,912,236 A * 10/1975 Zipperer et al. ..... 259/24
4,003,521 A * 1/1977 Hess ..... 241/82.1
4,240,591 A * 12/1980 Schnell ..... 241/82.4
4,358,061 A * 11/1982 Richter ..... 241/82.4
4,606,505 A * 8/1986 Simousen ..... 241/82.5
4,844,372 A * 7/1989 Weiler et al. ..... 241/82.4
4,955,549 A * 9/1990 Reinhall ..... 241/80

FOREIGN PATENT DOCUMENTS

DE 32 05 323 * 12/1982
DE 296 01 686 * 3/1996
GB 869 409 * 5/1961

* cited by examiner

*Primary Examiner*—Allen Ostrager
*Assistant Examiner*—William Hong
(74) *Attorney, Agent, or Firm*—Flynn, Thiel, Boutell & Tanis, P.C.

(57) ABSTRACT

In a comminution machine, which is particularly used in industry, with an emulsifier (3), a particularly simple structure with a single driving device for conveying, cutting and emulsifying the material to be chopped is guaranteed when, between a support body (32*a*) on a stator (32) of the emulsifier (3) and a fulling body (33*a*) on the corresponding rotor (33), there is a successively narrowing gap (36*a*) area in which the material to be chopped is exposed to a further constant fulling comminution under pressure. The rotor (33) is rotationally connected with the shaft (4) of the cutting and conveying device of the comminution device. On the rotor (33) a co-axial hub (33*c*) connected to the fulling body, is provided, with which hub the rotor (33) is fitted on the shaft (4).

17 Claims, 5 Drawing Sheets

COMMINUTION MACHINE WITH AN EMULSIFIER

FIELD OF THE INVENTION

The invention relates to a comminution machine, in particular a meat mincer, including an emulsifier, a comminution device stored in a housing for chopping the meat or similar material, which comminution device is advantageously provided with a least one set of knives driven by a shaft and associated with a rotationally fixed perforated disk, a device for feeding the material to be chopped into the comminution device, a drive, and an outlet for the comminuted material, which is provided on an emulsifier housing connected to the housing and enclosing an emulsifier.

BACKGROUND OF THE INVENTION

The emulsifier is supposed to take care that the minced material is evenly mixed and emulsified with separately supplied admixtures, whereby the interior of the emulsifier is connected to a negative pressure source, and thus the air contained in the emulsifying minced material is withdrawn therefrom.

The purpose of the invention is to connect a comminution machine of the above-identified type in a compact simple design to the emulsifier and to construct same in such a manner that the material to be comminuted is moved uniformly and well mixed out of the comminution machine.

The purpose is attained according to the invention in such a manner that a rotation-symmetrical stator with a support member is constructed on the emulsifier housing, which stator envelopes with an inwardly facing support surface an outwardly facing fulling surface, which is provided on a fulling body of a rotor rotationally connected to the shaft and adapted to the stator, in such a manner that between the support surface and the fulling surface there is constructed a wedge-shaped converging gap coaxially extending around a common axis of the rotor and the stator, and that a coaxial hub connected to the fulling body is provided on the rotor, with which hub the rotor is supported on the shaft.

It is particularly advantageous when the fulling body is constructed hollow-conical and thus encloses an otherwise available hollow-cone chamber as part of the inside of the emulsifier. The support member and/or the fulling body can in a simple manner have a wall each with a uniform wall thickness, if one thereby disregards the, if necessary, not smooth surfaces.

The minced material emulsifies particularly well when the gap is tapered toward the front surfaces of the rotor and of the stator, which front surfaces do not face the cutting device and are equilateral with respect to the common axis, whereby the front surfaces each form the bases of the support member/fulling body, which bases belong to the support surface and the fulling surface; the minced material is in this manner subjected to a continuously increasing static pressure up to the outlet. The comminution device can be designed as a cutting device.

A particularly preferred embodiment of the invention is a coaxial hub connected to the fulling body is provided on the rotor, with which hub the rotor is supported on the shaft so that a separate device for the emulsifier is not needed. The hub is arranged on the shaft preferably indirectly through an operating means for the set of knives, which operating means is axially movable on the shaft with the help of a clamping device. It is thereby advantageous when the hub is provided on the side of the fulling body determined by its smaller diameter; the shaft can therefore extend with its free end into the hollow-cone chamber of the fulling body so that it can there be utilized for further tasks not connected to the emulsifier; for example a clamping device for the cutting device can be mounted thereon.

The minced material emulsifies very well when the support surface of the stator and/or the fulling surface of the rotor are provided with several adjacent, preferably groove-shaped, coaxial annular grooves, whereby in each case the entire support surface and/or fulling surface can be occupied up by annular grooves.

Instead, it is also possible for the support surface of the stator and/or the fulling surface of the rotor to have preferably grooved-shaped longitudinal grooves, which are each parallel to them; as a rule it is best when annular grooves on the support surface are combined with longitudinal grooves on the fulling surface.

The flow of the minced material can be supported when the annular grooves are crossed by preferably groove-shaped longitudinal grooves extending transversely to them and being parallel to the support surface or the fulling surface such that they connect adjoining annular grooves with one another, whereby an unhindered flow in turn can be easily avoided in such a manner that the longitudinal grooves are arranged offset to one another so that the minced material must continuously change its flow direction.

It is understood that in place of the annular grooves it is also possible to provide spiral-shaped or helically shaped grooves, which are spaced from one another; however, it is also conceivable depending on the desired degree of emulsification that the support surface of the stator and/or the fulling surface of the rotor are designed as smooth conical surfaces.

A particularly compact design of the emulsifier is achieved when the gap transfers over into an annular chamber, which is connected to the outlet and is constructed between the pipe connection of the stator and of the rotor.

A good suction action on the minced material can be guaranteed in such a manner that the gap, preferably near the annular chamber, is fluidly connected through at least one opening in the fulling body first to the hollow-cone chamber of the fulling body, which hollow-cone chamber does not face the gap, and from there through a housing outlet to a negative pressure source.

Since a separate drive for the rotor of the emulsifier is not needed because of the inventive arrangement, it is best when the drive acting onto the shaft is provided for the cutting device, the conveying device and the emulsifier.

As a whole the invention permits a very compact arrangement of the emulsifier on the mincer, and yet simultaneously enables the emulsifier to adapt to the minced material or material to be chopped and emulsified and to create very different products solely by exchanging the rotor and/or the stator.

BRIEF DESCRIPTION OF THE DRAWINGS

The invention will be discussed in greater detail hereinafter in connection with one exemplary embodiment and the drawings, in which.

DETAILED DESCRIPTION

Figure 1:
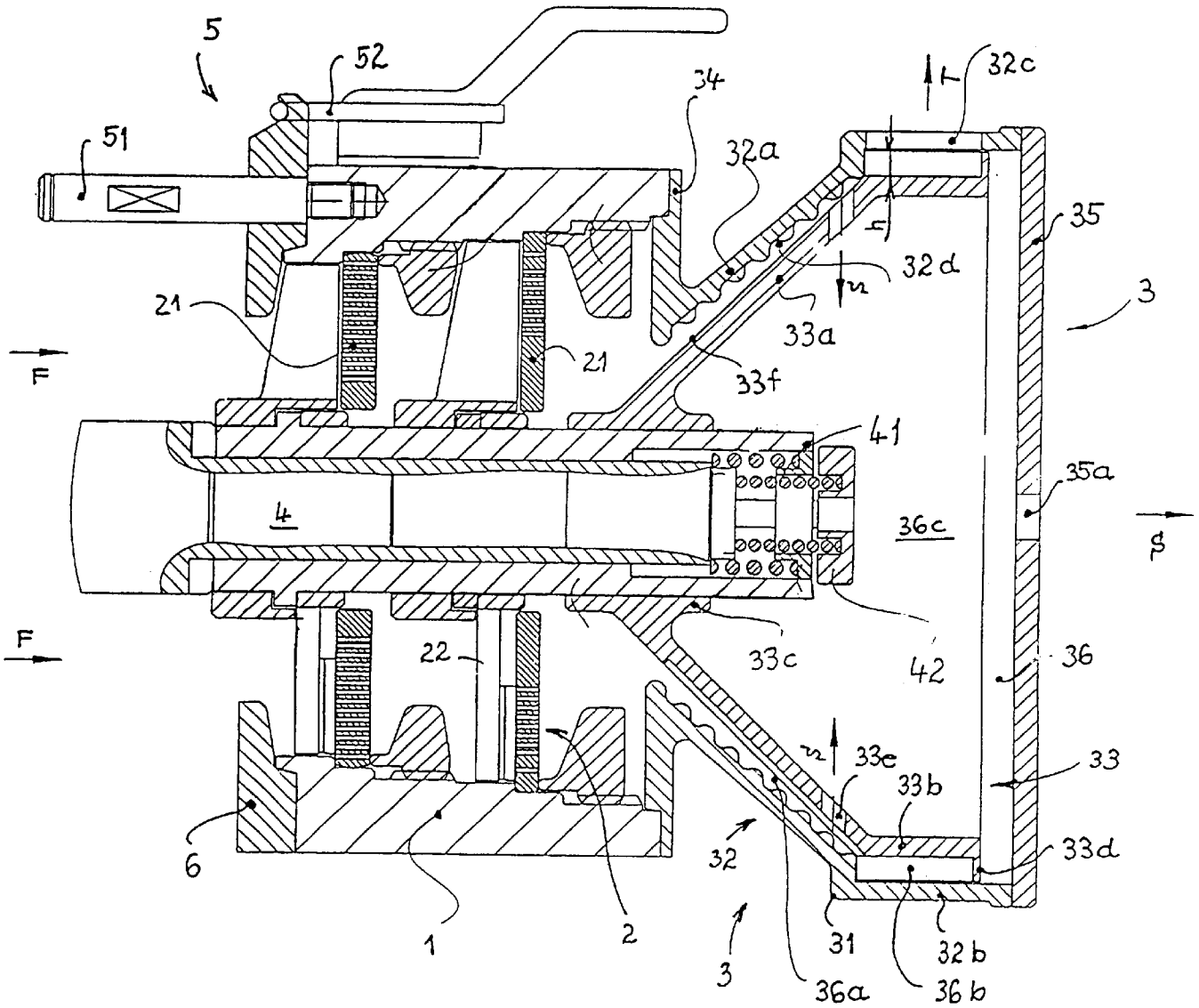
FIG. 1 is a longitudinal cross-sectional view of a mincer of the invention in its position of use.

A mincer according to the invention comprises according to FIG. 1 essentially of a cutting device 2 housed in a mincer housing 1, a conveying device, not shown in the drawing, for transporting the material to be cut in a direction corresponding with the conveying direction F into the cutting device 2, an emulsifier housing 31 for the emulsifier 3, which housing 31 is connected to the mincer housing 1, and a rotative drive for a shaft 4, which drive is not visible in the drawing. The shaft 4 takes care of the operation of the conveying device, which, for example, is constructed as a conveyor worm, of the cutting device 2 and of the emulsifier 3.

The cutting device 2 includes in a conventional manner of rotationally fixed perforated disks 21 arranged in the mincer housing 1 and sets of knives 22 each associated with the disks, which knives are supported fixed against rotation, however, axially movably on the shaft 4 and are pulled by a suitable clamping device 41 against the respective perforated disk 21.

The mincer can, in its entirety be easily exchangeable and be fixed in a stationary housing 6 by means of a holding device 5, whereby the holding device 5 includes several sinkable holding bolts 51 provided in the mincer housing 1 and a suitable clamping connection 52. The drive and the conveying device can be housed in the housing 6.

The emulsifier 3 according to the invention comprises individually of a stator 32 and a rotor 33.

The stator 32 is part of the emulsifier housing 31 including a connecting flange 34, with which the emulsifier housing 31 is easily releasably flanged onto the mincer housing 1. A hollow-conical support member 32*a* and an outer pipe connection 32*b* connected to the support member 32*a* are provided on the stator 32, the open front side of which pipe connection, which does not face the support member 32*a*, is closed off by means of a lid 35.

The frustum-shaped support member 32*a* is arranged in such a manner that the associated angle of opening "a" (FIGS. 4, 5) is open in the conveying direction F.

An opening 35*a* is provided in the lid 35, through which opening the inside 36 of the emulsifier 3, which inside is common to the stator 32 and the rotor 33, is connected to a negative pressure source and is subjected to same in the flow direction S. Whereas the emulsified end product is removed from the mincer in the transporting direction T through an outlet 32*c* in the pipe connection 32*b*, which transporting direction, as are the conveying direction F and the flow direction S, is illustrated merely by a directional arrow.

The stator 32 encloses with its support member 32*a* and its pipe connection 32*a* a hollow-conical fulling body 33*a* of the rotor 33 and a similar inner pipe connection 33*b* of the rotor 33, which pipe connection 33*b* is attached to the fulling body 33*a*.

Both the support member 32*a* and also the fulling body 33*a* have, aside from the various designs of their surfaces, each a uniform wall thickness "s" (FIGS. 2–5).

The arrangement is thereby such that (just like the support member 32*a*) the frustum-shaped fulling body 33*a* is with an associated angle of opening "b" (FIGS. 2, 3) open in the conveying direction F, which angle is slightly larger than the angle of opening "a" of the support member 32*a* so that a conical gap 36*a* is created between both, which gap continuously narrows in direction of the pipe connections 32*b*, 33*b*, which close off each the stator 32 and the rotor 33 in the conveying direction F.

Whereas an annular chamber 36*b* constructed between the pipe connections 32*b*, 33*b*, from which annular chamber the end product is removed through the outlet 32*c*, is of a constant height "h" throughout.

The rotor 33 is rotationally connected to the shaft 4 through a hub 33*c*, which is attached to the fulling body 33*a* on the side opposite the pipe connection 33*b* and closes off a hollow-cone chamber 36*c* of the fulling body 33*a* toward the cutting device 2. The axially movable hub 33*c* is here not directly supported on the shaft 4 but instead on an operating means 42 for the sets of knives 22, which operating means is guided on the shaft 4 and is axially movable with the help of the clamping device 41. It is obvious that the rotor 33 is fixed axially in a suitable manner, for example, by means of the lid 35; the details, which are common in this field of art, are left out of the drawings.

A circular sealing flange 33*d* of individual lips (FIGS. 2, 3) following the inner pipe connection 33*b* is provided on the rotor 33, which sealing flange extends to the outer pipe connection 32*b* and prevents the minced material moving from the annular chamber 36*b* into the remaining inner chamber 36.

Finally, a plurality of radial openings 33*e* exist in the fulling body 33*a* near the inner pipe connection 33*b*, through which openings the gap 36*a* is fluidly connected to the hollow-cone chamber 36*c* and further to the negative pressure source; the flow direction S is also here indicated.

Figure 2B:
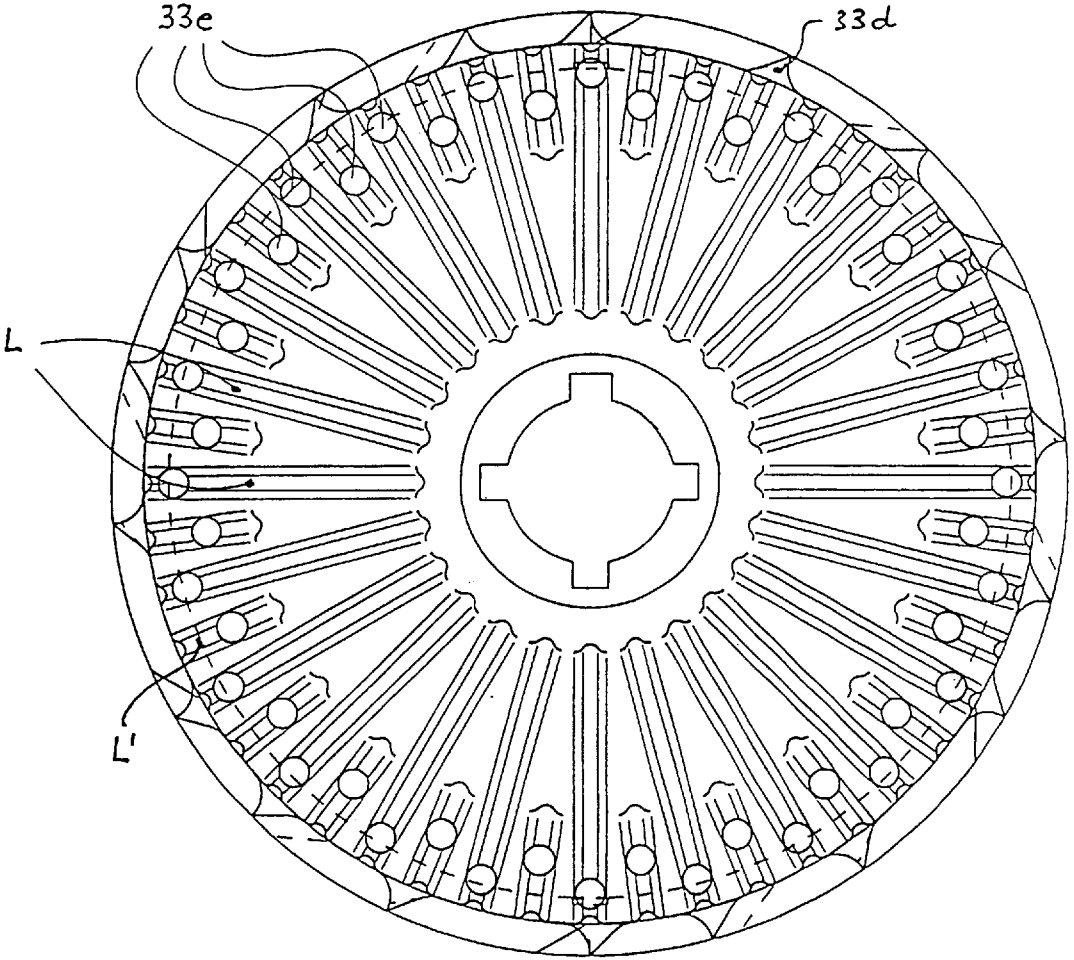
FIG. 2 illustrates in two parts 2*a*, 2*b* a first embodiment of a rotor in a longitudinal cross-sectional view of the position of use and in the associated side view.
Figure 2A:
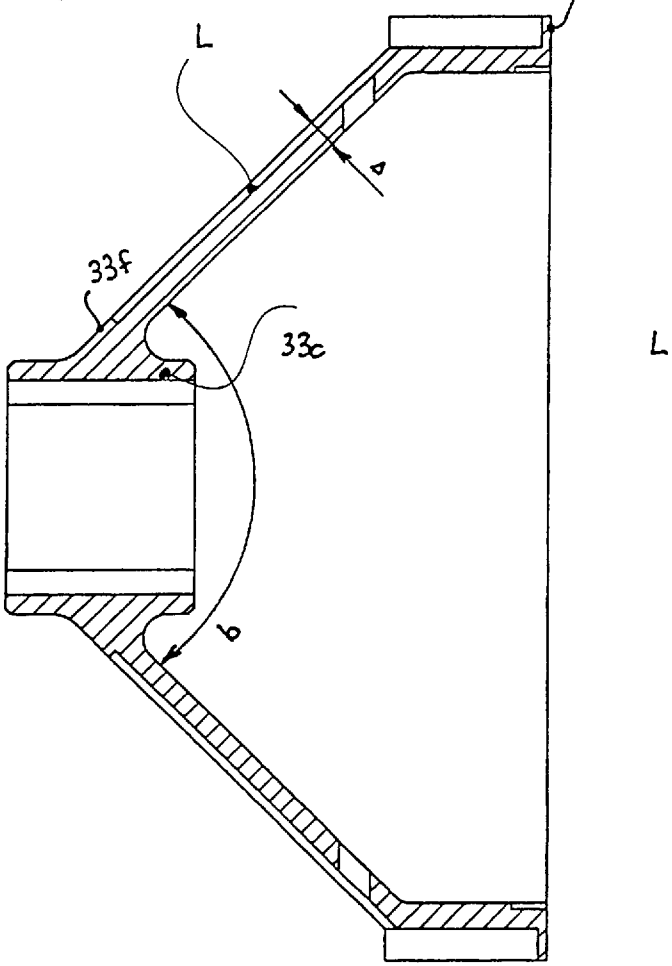
Figure 3B:
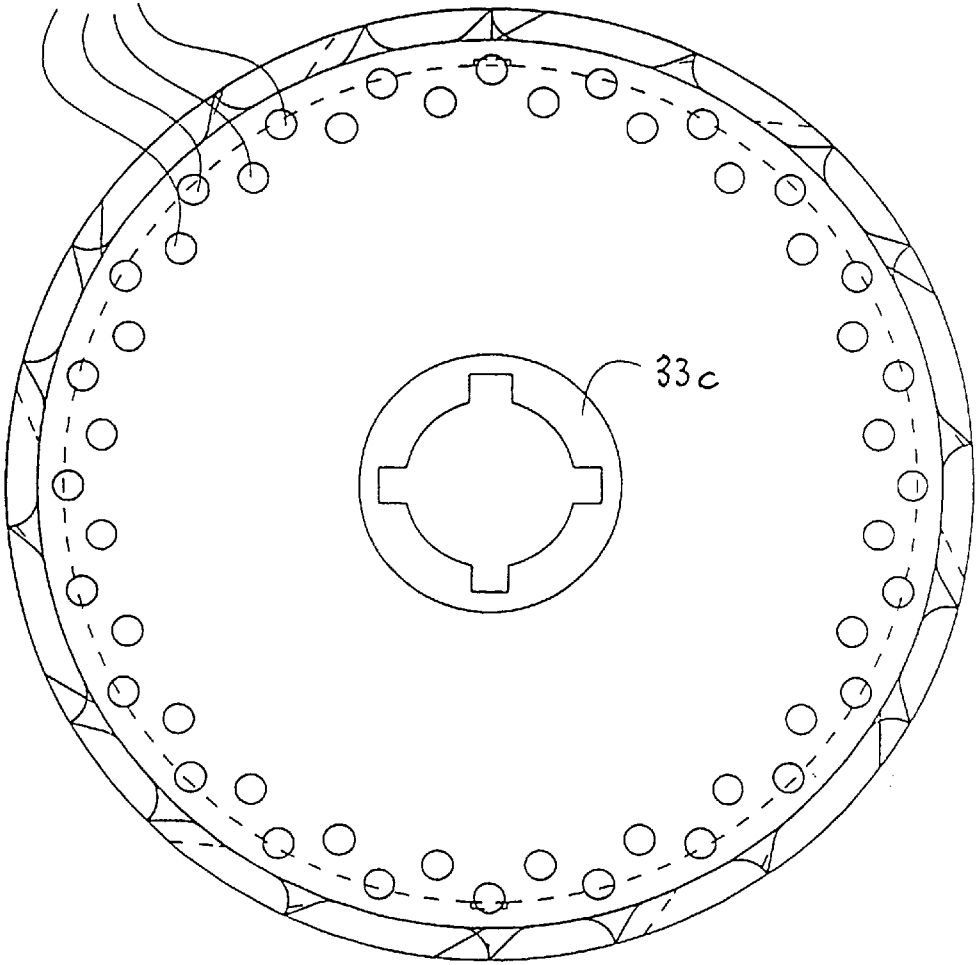
FIG. 3 illustrates in two parts 3*a*, 3*b* a second embodiment of a rotor in the longitudinal cross-sectional view of the position of use and in the associated side view.
Figure 3A:
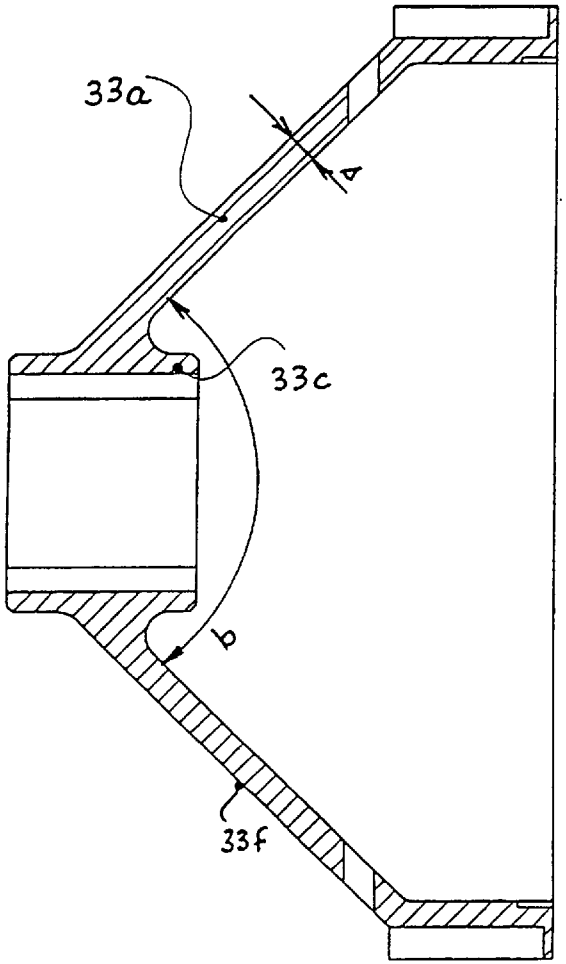

FIGS. 2, 3 illustrate in greater detail two different rotors 33 according to the invention. FIG. 2 shows a rotor 33 with a fulling surface 33*f*, which is provided on the side of the fulling body 33*a* directed toward the gap 36*a* and has a plurality of longitudinal grooves L, which in the side view of the FIG. 2*b* point radially outwardly from the axis of symmetry, extend parallel to the fullying surface 33*f* in the longitudinal direction (FIG. 2*a*), and start in the vicinity of the hub 33*c*, and in which longitudinal grooves the minced material in the gap 36*a* can flow continuously outwardly; other longitudinal grooves L' (FIG. 2*b*) provided between the longitudinal grooves L are slightly shorter so that longitudinal grooves L, L' extend through the entire fulling surface 33*f*. Instead the rotor 33 of FIG. 3 has a completely smooth fulling surface 33*f*, and other surface forms can also be used; thus it is, for example, conceivable that the fulling surface 33*f* is designed similarly to a support surface 32*d* provided on the support member 32*a* on its side pointing toward the gap 36*a* (FIG. 4).

Figure 4B:
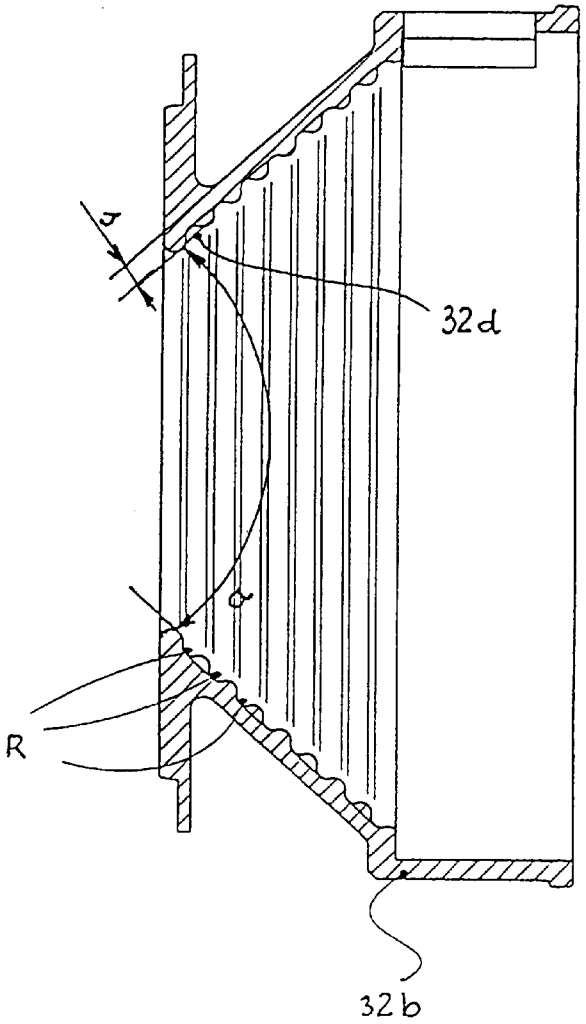
FIG. 4 illustrates in two parts 4*a*, 4*b* a first embodiment of a stator of a view illustrated against the conveying direction of the cutting material and an associated side view corresponding with the position of use.
Figure 4A:
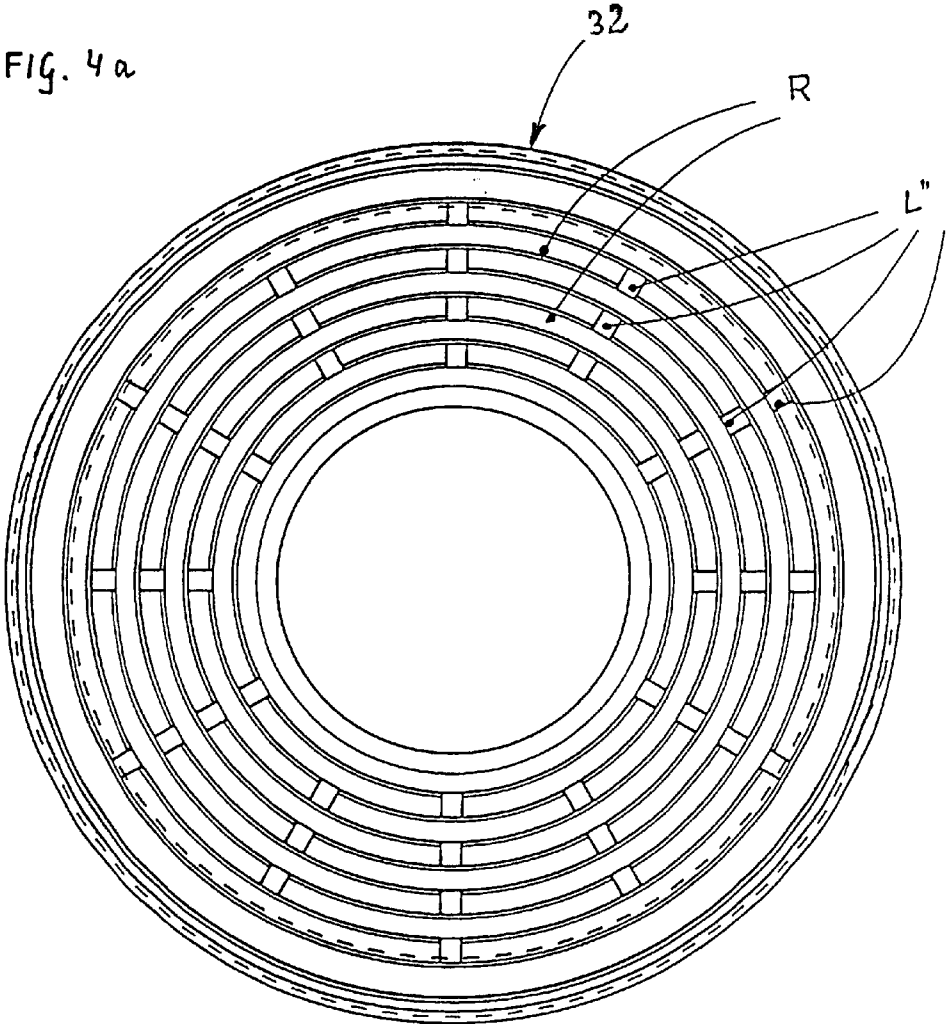
Figure 5B:
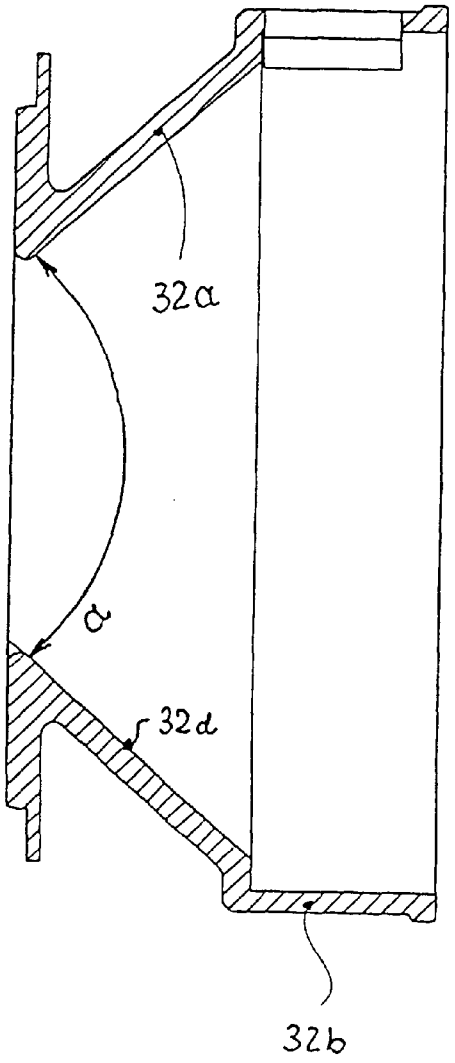
FIG. 5 illustrates in two parts 5*a*, 5*b* in the same illustration a second embodiment of a stator, all schematically simplified.
Figure 5A:
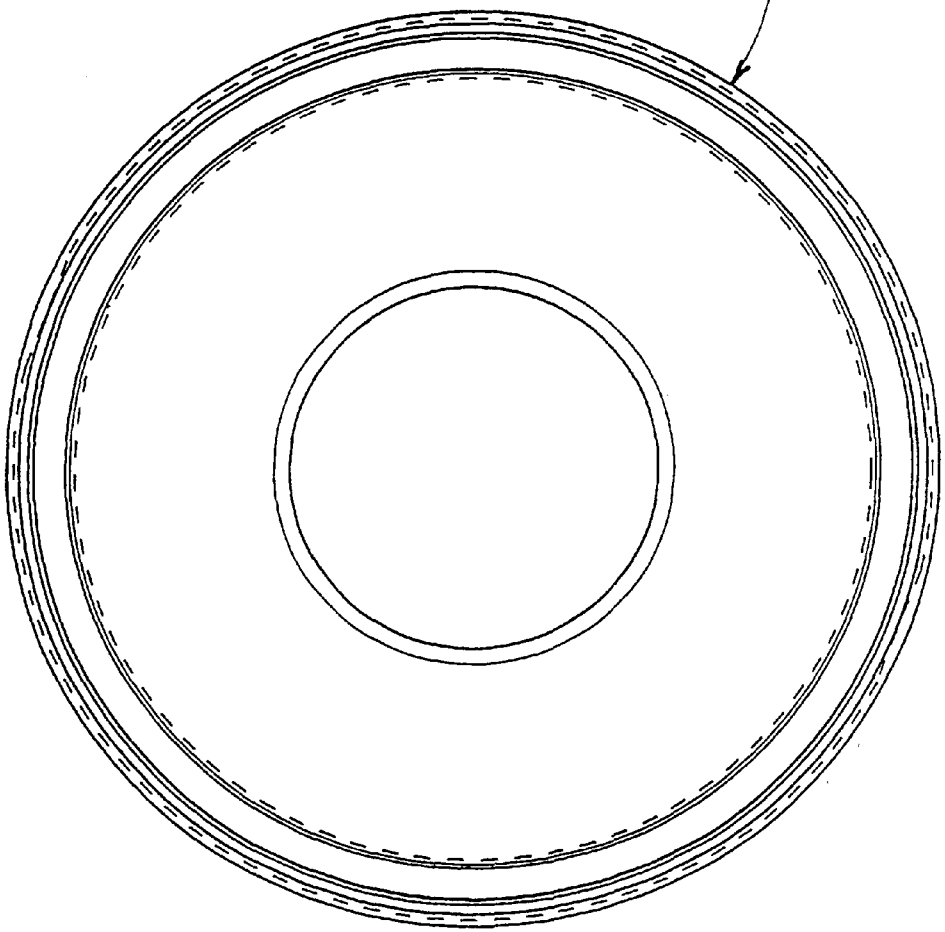

FIGS. 4, 5 of the drawings disclose examples for the design of the support surface 32*d*. The embodiment of FIG. 4 is thereby constructed with concentric, closely adjacent and groove-shaped annular grooves R on the support surface 32*d*, which in particular in the manner illustrated in FIG. 1 cause together with the longitudinal grooves L, L' a strong fulling and comminution of the minced material. It is here also possible to provide short longitudinal grooves L" extending perpendicular to the annular grooves R, through which the minced material can flow from one annular groove R to the radially outward next one. Similar to the fulling surface 33*f* in the fulling member 33*a*, the support surface 32*d* can here too be completely smooth (FIG. 5);

however, other surface forms enhancing the fulling operation are also possible, as, for example, spiral-shaped or helically shaped grooves.

Reference Numerals

1 mincer housing
2 comminution device/cutting device
21 perforated disk
22 set of knives
3 emulsifier
31 emulsifier housing
32 stator 52 clamping connection
32*a* support member
32*b* (outer) pipe connection
32*c* outlet
32*d* support surface
33 rotor
33*a* fulling body
33*b* (inner) pipe connection
33*c* hub
33*d* sealing flange
33*e* opening
33*f* fulling surface
34 connecting flange
35 lid
35*a* opening
36 inside
36*a* gap
36*b* angular chamber
36*c* hollow-cone chamber
4 shaft
41 clamping device
42 operating means
5 holding device
51 holding bolt
6 housing
a,b angle of opening
h height
s wall thickness
F conveying direction
L,L',L" longitudinal groove
R annular groove
S flow direction
T transporting direction

What is claimed is:

1. In a comminution machine, comprising in series a feeding device for feeding the material to be chopped, a comminution device and an emulsifier, said comminution device being housed in a housing for chopping meat or similar material delivered to it by the feeding device, said comminution device having at least one set of knives driven by a shaft and associated with a rotationally fixed perforated disk, and an outlet for the comminuted material provided on an emulsifier housing connected to the housing and enclosing the emulsifier, the improvement wherein a rotation-symmetrical stator with a support member is provided on the emulsifier housing, said stator having an inwardly facing support surface enveloping an outwardly facing fulling surface provided on a fulling body of a rotor rotationally connected to the shaft and conformed to the stator such that between the support surface and the fulling surface there is provided an axially extending wedge-shaped converging gap coaxially extending around a common axis of the rotor and the stator, and wherein a hub is provided on the rotor and effecting securement of the rotor to the shaft.

2. The comminution machine according to claim 1, wherein at least one of the support surface of the stator and the fulling surface of the rotor have longitudinal grooves, which are parallel to each other.

3. The comminution machine according to claim 1, wherein the fulling body is constructed hollow-conical.

4. The comminution machine according to claim 1, wherein the support member and the fulling body each have a wall with the same wall thickness.

5. The comminution machine according to claim 1, wherein the gap is tapered toward front surfaces of the rotor and of the stator remote from the cutting device and are equilateral with respect to the common axis.

6. The comminution machine according to claim 5, wherein the front surfaces each form the bases of the hollow-conical support member and fulling body.

7. The comminution machine according to claim 1, wherein the hub is indirectly fastened through an operating means for the set of knives to the shaft by a clamping device.

8. The comminution machine according to claim 1, wherein a drive acting onto the shaft is provided for the series oriented conveying device, the cutting device and the emulsifier.

9. The comminution machine according to claim 1, wherein the support surface of at least one of the stator and the fulling surface of the rotor are provided with several adjacent coaxial annular grooves.

10. The comminution machine according to claim 9, wherein the entire support surface and fulling surface are provided with annular grooves.

11. The comminution machine according to claim 9, wherein the annular grooves are crossed by longitudinal grooves extending transversely thereto and are parallel to the support surface or the fulling surface such that they connect adjacent annular grooves with one another.

12. The comminution machine according to claim 11, wherein the longitudinal grooves are arranged offset to one another.

13. The comminution machine according to claim 1, wherein the support surface and the fulling surface are each constructed frustum-shaped.

14. The comminution machine according to claim 13 wherein at least one of the support surface and the fulling surface are constructed as smooth conical surfaces.

15. The comminution machine according to claim 2 wherein the hub is provided on a smaller diameter side of the fulling body.

16. The comminution machine according to claim 1, wherein the gap transitions into an annular chamber provided between pipe connections of the stator and of the rotor and thence to the outlet.

17. The comminution machine according to claim 16, wherein the gap adjacent the annular chamber is fluidly connected to a negative pressure source through at least one opening in the fulling body.

* * * * *